US006263712B1

(12) United States Patent
Ramsauer

(10) Patent No.: US 6,263,712 B1
(45) Date of Patent: Jul. 24, 2001

(54) SWIVELLING LEVER CONTROL THAT CAN BE PADLOCKED FOR CLOSING SWITCHBOARD CABINET DOORS OR THE LIKE

(76) Inventor: Dieter Ramsauer, Am Neuhauskothen 20, D-42555 Velbert (DE)

( * ) Notice: Subject to any disclaimer, the term of this patent is extended or adjusted under 35 U.S.C. 154(b) by 0 days.

(21) Appl. No.: 09/254,212

(22) PCT Filed: May 8, 1998

(86) PCT No.: PCT/EP98/02709

§ 371 Date: Mar. 3, 1999

§ 102(e) Date: Mar. 3, 1999

(87) PCT Pub. No.: WO99/01632

PCT Pub. Date: Jan. 14, 1999

(30) Foreign Application Priority Data

Jul. 4, 1997 (DE) ..... 297 11 740 U

(51) Int. Cl.[7] ..... E05B 13/00

(52) U.S. Cl. ..... 70/208; 70/212; 292/148; 292/205; 292/281; 292/DIG. 31

(58) Field of Search ..... 70/208, 2, 3, 6, 70/54–56, 203, 212; 292/DIG. 31, 148, 205, 281

(56) References Cited

U.S. PATENT DOCUMENTS

| | | | | |
|---|---|---|---|---|
| 4,930,325 | * | 6/1990 | Ramsauer | 70/209 |
| 5,450,734 | * | 9/1995 | Esaki et al. | 70/208 |
| 5,454,239 | * | 10/1995 | Esaki et al. | 70/208 |
| 5,467,623 | * | 11/1995 | Yamada et al. | 70/208 |
| 5,469,725 | * | 11/1995 | Yamada | 70/208 |
| 5,722,269 | * | 3/1998 | Simon et al. | 70/208 |
| 5,970,757 | * | 10/1999 | Ramsauer | 70/208 |

FOREIGN PATENT DOCUMENTS

0261266 * 3/1988 (EP) .

* cited by examiner

*Primary Examiner*—Lloyd A. Gall
(74) *Attorney, Agent, or Firm*—Reed Smith LLP

(57) ABSTRACT

The disclosure relates to a swivel lever actuator which can be secured by a padlock for the closure of switch cabinet doors or the like, with a dish which is arranged on the outer surface of the door leaf or the like and in which is arranged the lock shaft, wherein an actuating lever is articulated at the free end of the lock shaft as to be swivelable out of the dish about an axis extending transverse to the shaft axis, and with a projection supported by the dish, wherein an eyelet is arranged at the free end of the projection in such a way that when the lever is swiveled into the dish the projection and a padlock inserted through the eyelet prevents the actuating lever from swiveling out. The actuating lever, forms an offset surface in the area of the opening, which offset opening receives the shackle inserted through the eyelet.

24 Claims, 6 Drawing Sheets

SWIVELLING LEVER CONTROL THAT CAN BE PADLOCKED FOR CLOSING SWITCHBOARD CABINET DOORS OR THE LIKE

This application is a 371 application of PCT/EP98/02709.

BACKGROUND OF THE INVENTION a) Technical Field

The invention is directed to a swivel lever actuator which can be secured by a padlock for the closure of switch cabinet doors or the like, with a trough or dish which is arranged on the outer surface of the door or the like and in which is arranged the driving device for the closure, such as a toothed-wheel drive, lever drive or lock shaft, wherein an actuating lever is articulated at the driving devices so as to be swivelable out of the dish about an axis extending parallel to the outer surface of the door or the like, and with a projection mounted on the dish, wherein an eyelet is arranged at the free end of the projection in such a way that when the actuating lever is swiveled into the dish the projection extends through an opening in the actuating lever and a padlock inserted through the eyelet prevents the actuating lever from swiveling out.

b) Description of the Related Art

A swivel lever actuator of the type mentioned above which can be secured by a padlock is already known from page 2–105 of a catalog from DIRAK GmbH & Co. KG, Kaiserstr. 55–59, 58332 Schwelm. A disadvantage in this known arrangement is that the projection projects far over the surface of the swiveled in swivel lever and accordingly presents an obstacle to persons passing by. Due to the fact that the projection in the center of the dish projects out very far, it also impedes the user's hand when the lever is swiveled out.

A closure for sheet-metal cabinet doors having a retractable or lowerable handle is known from DE 42 10 588 C2. This patent centers around the set of problems associated with the displaceable cover cap for a keyhole. Also described, however, is the possibility of fixing the swivel lever in the swiveled in state by means of a hook which can be swiveled out of its fixing position by the locking plate of a cylinder lock, whereupon the swivel lever is released.

A swivel lever closure which can be fixed in a swiveled in position by means of a cylinder lock and the locking plate thereof is known from EP 02 61 267. A hook device which hooks in automatically when the swivel lever closure is swung in is not provided. Also absent from this reference is an arrangement in which the swivel lever can be secured by means of a padlock.

It is known from WO 91 17 334 A1, see FIGS. 4 to 6 and claim 15, that a locking strip has a cam surface which is engaged by an edge formed by the base plate or by the opening in the door leaf when the swivel lever is swiveled into a lowered or recessed position and is accordingly pressed into the unlocked position against the spring force of a spring and that the cam surface is released again when the swiveled in position is achieved. Accordingly, locking can easily be carried out in this case by swiveling in the swivel lever. A key is not required for locking. However, it is not possible to lock the swivel lever by means of a padlock.

FR 25 84 093 A1 shows, in FIGS. 1 and 2, an actuating lever which can be fixed in a determined position by a padlock.

U.S. Pat. No. 4,134,281 describes a folding lever, that is, not a swivel lever. In the folded in state, the folding lever can be held by a locking lever 64 mounted in the dish as well as by a cylinder lock 66 which is accommodated in the folding lever. The folding lever can be accommodated in a housing 70 in a recessed manner. The cylinder lock 66, with its locking plate 130, represents a first locking member. In normal use, this locking member holds the handle 16 in its swiveled in position. The folding lever is unlocked by pressing on a surface 96 of the structural component part 64. This is shown in FIGS. 6 and 4. The lever 64 has an opening 150 which, however, is not disclosed more fully in the description. Presumably, a shackle of a padlock can be placed through this opening in order to secure the lever against unauthorized opening. The folding lever 60 is provided with a bent back portion which can be seen in FIG. 4, but which is not discussed more fully in the text. As is stated in the abstract, this is a door closure for truck doors.

U.S. Pat. No. 5,467,623 relates to a swivel lever actuator which is locked in the swiveled in state by a locking lever 27 which is accommodated in the swivel lever. The locking member 33 of a cylinder lock 20 engages in the movement path of this locking lever, preventing its actuation, and therefore prevents the release of a hook device which engages behind a back-engagement 35 in the swiveled in state of the actuating lever and is held by the back-engagement 35. When the locking member is turned away, the lever 27 can be swiveled by thumb pressure out of its position in which it is held by the spring 35 against the force of a helical spring 26, whereupon the swivel lever is then swiveled out by means of an additional pressure spring 18 which is arranged in the area of its swiveling axis. A device enabling additional locking by means of a padlock is not described.

U.S. Pat. No 5,440,905 describes a swivel lever with a locking mechanism 11 which releases the swivel lever from its locked position by means of pressing a button on the swivel lever. A cylinder lock displaces a bar 20 behind which the projecting part of the push button engages. By means of a cylinder key, this slide can be displaced in such a way that it is no longer possible to unlock by means of the push button. This reference also does not offer the possibility of additionally securing the swivel lever by means of a padlock.

OBJECT AND SUMMARY OF THE INVENTION

An essential object of the invention is to further develop an arrangement of the type mentioned above in such a way that the projection with the eyelet through which the padlock can be inserted is less obtrusive.

This object is met in that the actuating lever forms an offset surface in the area of the opening, wherein the shackle of the padlock which is inserted through the eyelet is received by the offset surface in a well fitting manner.

According to a further development, the dish can also have, in the area of the shackle, a countersink or recess which receives the shackle in a well fitting manner.

A further disadvantage in the known arrangement consists in that security against swiveling out is only present when a padlock is actually inserted.

There are also cases where a padlock of this kind is not to be provided, at least occasionally; in such cases, the known arrangement is not protected against an unwanted swiveling out of the swivel lever. A swiveling out of this kind can occur when the swivel lever exits the dish due to a shaking movement such as can occur during an earthquake or also during operation on vibrating machinery, resulting in the risk that the swivel lever will rotate to the extent that the closure device opens and the door leaf or switch cabinet device secured by the closure remains open. Switch cabinets located, for example, on crane installations where there are often a plurality of, e.g., as many as 30, switching installations which are enclosed by a switch cabinet are exposed to particularly violent shaking movements. Unwanted opening of such switch cabinet doors due to shaking cannot be tolerated. In the known arrangement, it is possible to provide a profile cylinder which can likewise secure the actuating lever independent from the padlock. However, the combination of a swivel lever closure with a padlock as well as a profile cylinder makes the arrangement complicated because two keys are then necessary: a first key for the padlock and a second key for the profile cylinder. The known arrangement also does not allow the actuating lever to be simply pressed in and locked. If a key-operated arrangement is provided, it must first be closed by means of keys or a padlock must be attached in order to achieve locking.

Therefore, another object of the invention is to further develop the known arrangement in such a way that the actuating lever can be pressed into its closing position and held therein so as to be secured also without the use of a padlock and without the use of a key-actuated cylinder.

Further, it should be possible to remove the actuating lever from this pressed in secured position without the need for special tools.

These additional objects are met according to another embodiment form of the invention in that a hook is provided at the actuating lever, which hook engages a back-engagement surface of the dish when the actuating lever is swiveled in and accordingly holds the actuating lever in the swiveled in position.

When the hook has an actuating surface, wherein the hook is released from the back-engagement surface when the actuating surface is pressed, the swivel lever can be released again in a simple manner without additional tools.

The releasing movement of the hook is advantageously carried out against spring force because the hook is then held in its locked position more securely.

It is also advantageous when the actuating lever can be swiveled in against spring force because it then swivels out of its locked position when the lock is released without further manipulation.

It can be advantageous when the actuating lever also has an additional lock which can be actuated by means of a tool. This provides additional securing means which, although less secure than a padlock, still make it possible when a padlock is not available to lock in such a way that it cannot be opened without a tool.

It is advantageous in terms of construction when the dish has two protrusions which extend through the door leaf or the like, wherein one protrusion forms a lock shaft support and the other protrusion is formed by the fastening for the projection for the eyelet. This prevents rotation of the dish on the door leaf and, on the other hand, provides a fastening by means of parts which are already present and accordingly enables a twofold use of certain elements of the closure.

The protrusions can form circumferential threads on which fastening screw nuts can be screwed, wherein the door leaf is clamped between the fastening screw nuts and the dish. This results in a particularly simple assembly of the arrangement.

The swivel lever actuator according to the invention is suitable for actuating a quarter-turn or sash fastener, a flat rod closure or round rod closure.

BRIEF DESCRIPTION OF THE DRAWINGS

The invention will be described more fully hereinafter with reference to embodiment examples shown in the drawings.

DESCRIPTION OF THE PREFERRED EMBODIMENTS

Figure 1:
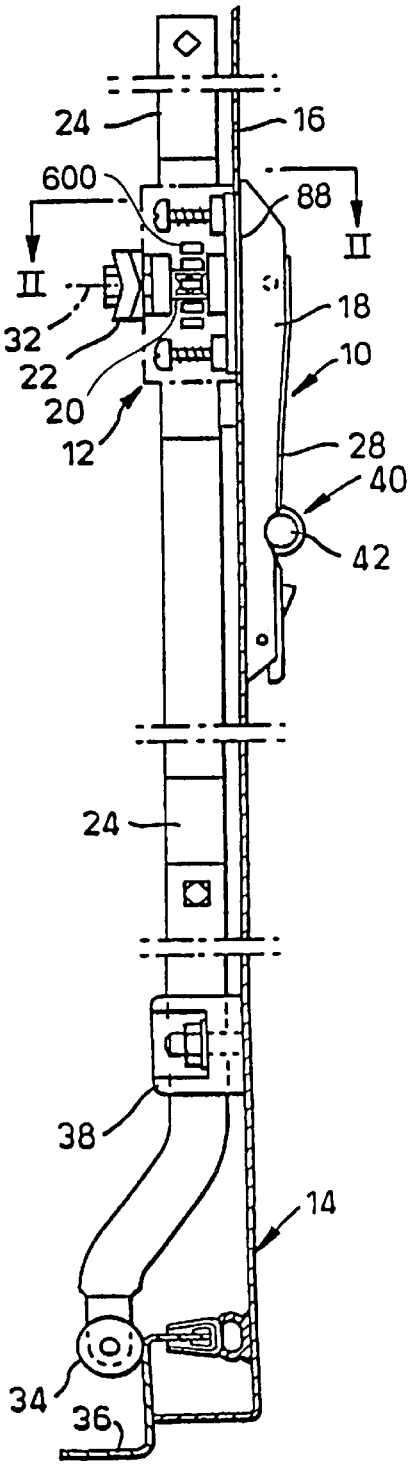
FIG. 1 is a side view of a swivel lever actuator which can be secured by a padlock for the closure of a switch cabinet door shown in combination with a flat rod closure installed in a switch cabinet.
Figure 3:
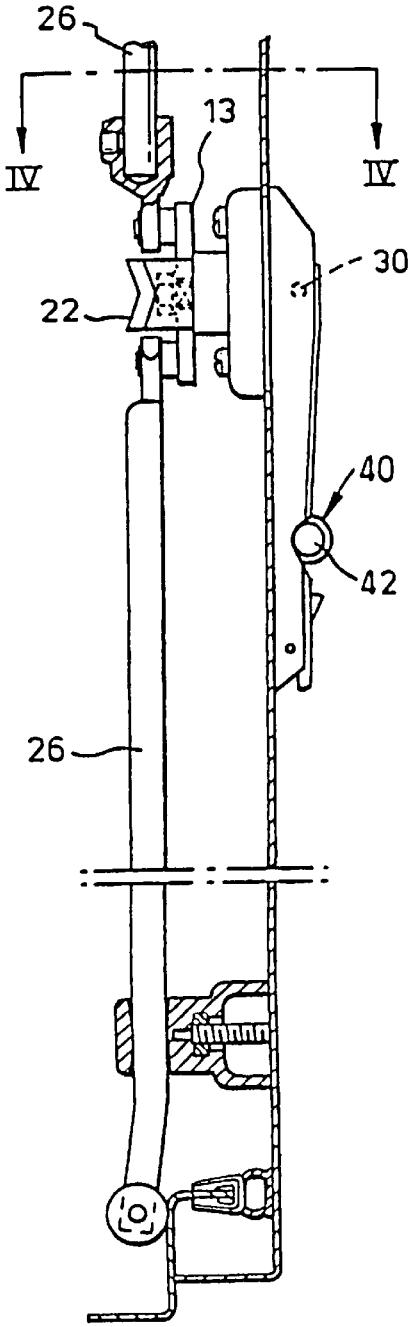
FIG. 3 shows the swivel lever actuator shown in FIG. 1, but in connection with a round rod closure installed in a switch cabinet door.

FIG. 1 is a side view showing a swivel lever actuator 10 for the closure 12 of a switch cabinet door 14, a housing wall (not shown), sheet-metal case cover or the like (not shown), with a dish 18 which is arranged on the outer surface 16 of the switch cabinet door 14 or the like and in which is arranged a lock shaft 20 which carries, for example, a sash 22 in a manner not shown in more detail and which, in this case, also drives flat strip lock rods 24 or, as is shown in FIG. 3, round rods 26, extending along the door leaf. For further details in this connection, reference is had to the European Patent 0 054 225. For example, a tooth-wheeled drive 600 connected to shaft 20 may be used.

Figure 2:
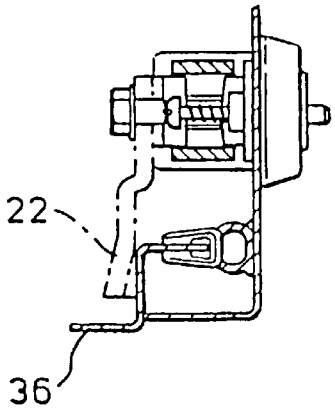
FIG. 2 shows a cross-sectional view through the arrangement according to FIG. 1 along line 11—11 of FIG. 1.
Figure 4:
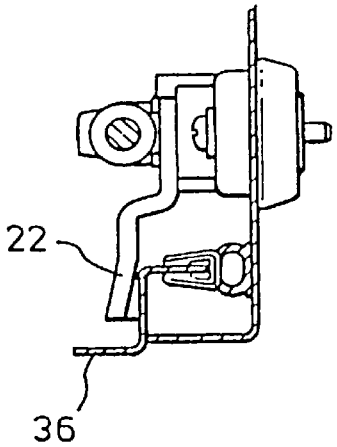
FIG. 4 shows a cross-sectional view through the closure according to FIG. 3 along section line IV—IV of FIG. 3.
Figure 11:
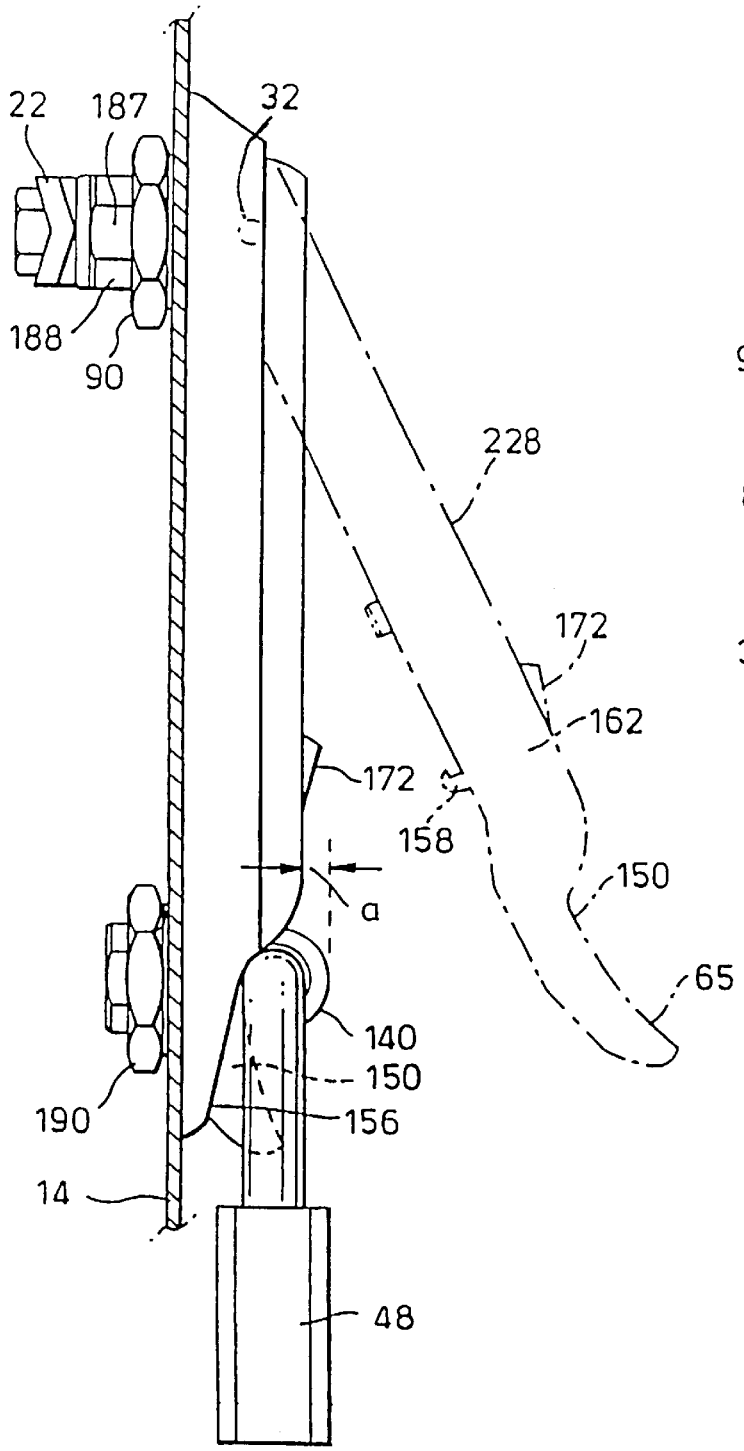
FIG. 11 shows a side view of the arrangement according to FIG. 9, wherein the swivel lever is shown in dashes in the swiveled out position.

An actuating lever 28 is articulated at the free end of the lock shaft 20 directed away from the sash so as to be swivelable out of the dish 18 about an axis 30 extending transverse to the axis of the shaft 20. In the swiveled out state which is shown in dashes in FIG. 11, the shaft 20 can be rotated with the actuating lever 28 about its axis 32, for example, in order to swivel a sash 22 behind the door frame 36 (see FIG. 2) of a switch cabinet, not shown, and accordingly to close the door. Alternatively or in addition, a door closure position is achieved, as shown in FIG. 1, by flat strip rods 24 which can be moved upward and downward, wherein a stop wheel 34 runs up on the edge, shown in FIG. 1, of a switch cabinet housing 36 and holds the door leaf 14 at which the locking rod 24 is guided by means of rod guides 38. In the embodiment form shown in FIGS. 1 and 3, the locking rods 24 are located in the locked position, while the actuating lever 28 faces downward (diagonally) as is shown in FIG. 11. In this position, the actuating lever 28 can be swiveled into the dish 18, in which position the actuating lever 28 is substantially enclosed by the dish edges. The devices described in the following should serve to hold the actuating lever 28 in this swiveled in position in which the actuating lever 28 is prevented from being rotated out of its position oriented to the dish due to the fact that it is enclosed by the dish edges. Therefore, it is not possible for the door to be opened.

When the actuating lever 28 is in its position in which it is directed vertically downward, its own gravitational force and friction are sufficient in themselves to hold it in this position. However, during shaking movements such as those which can occur, for example, in crane installations, there is a risk that the actuating lever 28 will move out of its swiveled in position again and into the swiveled out position shown in dashed lines in FIG. 11. In this position, rotation can also be carried out about axis 32 due to further shaking movement, so that the closure 12 opens in certain cases and therefore exposes the interior of the switch cabinet in an unwanted manner. It is also possible that an unauthorized person will swivel out the actuating lever 28 and move the door closure out of its closed position into an open position by rotating about the axis 32 and will accordingly be able to open the door 14 of the switch cabinet.

In order to prevent this, a projection 40 is provided. The projection 40 is supported by the dish 18 and is provided at its free end with an eyelet 42 in such a way that when the actuating lever 28 is swiveled into the dish 18 this projection 40 extends through an opening 44 in the actuating lever 28 and the shackle 46 of a padlock 48 can be inserted through the eyelet 42 so as to prevent the actuating lever 28 from swiveling out.

Figure 5:
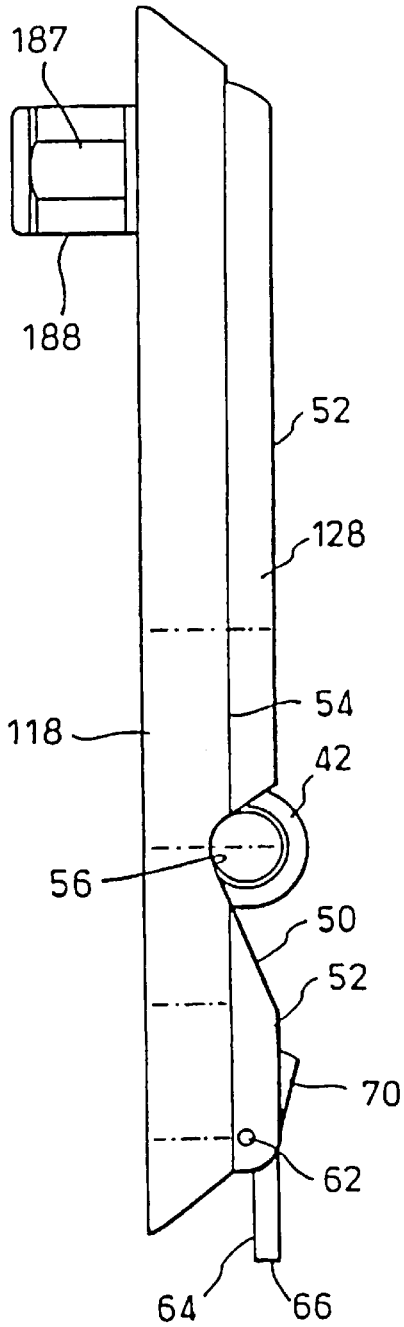
FIG. 5 shows an enlarged side view (approximately to scale) of a securable swivel lever actuator similar to that shown in FIG. 1.
Figure 6:
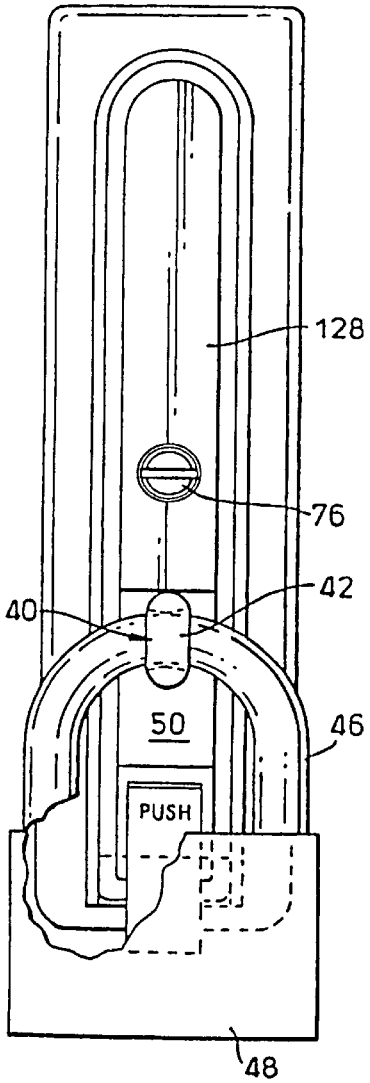
FIG. 6 shows a front view of the swivel lever actuator according to FIG. 5 with a padlock inserted.
Figure 7:
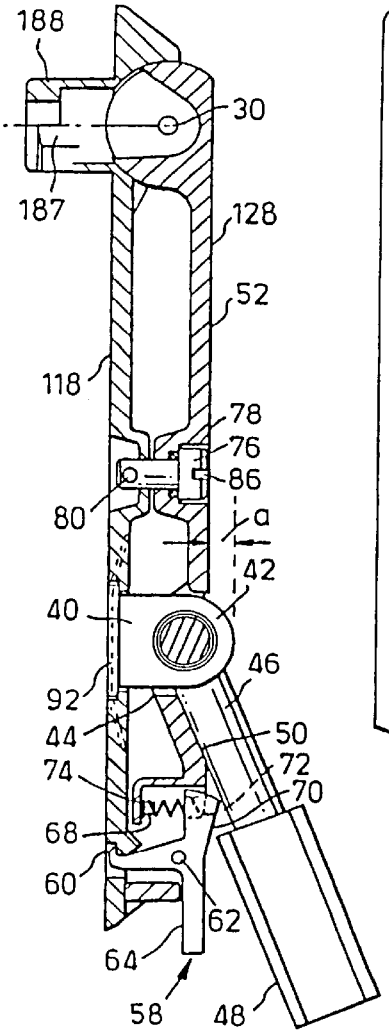
FIG. 7 shows a swivel lever actuator according to FIG. 6 in a side view in section along the longitudinal axis.

As can be seen in FIGS. 1 and 3, but especially, e.g., in FIGS. 5 and 7, the actuating lever 28 according to FIGS. 1 and 3, designated by 128 in FIGS. 5, 6 and 7, is outfitted in the area of the opening 44 for the projection 40 with an offset surface 50 which is constructed (see FIG. 5) in such a way that it receives, in a well fitting manner, the shackle 46 of the padlock 48 passing through the eyelet 42. This reduces the height of the projection 40 and therefore the degree to which the eyelet 42 projects over the front plane 52 of the actuating lever 128, for example, in this case to a distance a (see FIG. 7) which equals approximately half the diameter of the cross section of the shackle 46.

As can be seen in FIG. 5, the edge 54 of the dish 118 is countersunk (see reference number 56) in the area of the eyelet 42, so that the extent to which the eyelet 42 projects out can be further reduced if necessary.

The great advantage in securing by means of a padlock 48 consists in that an individual padlock 48 belonging to a certain person can be used, for example, at certain times and for certain reasons, so that it is possible for this person to secure a door against unauthorized opening. Only this person can open the padlock again by means of the key belonging to this padlock, remove it and then open the door closure by folding out and subsequently turning the actuating lever. If a special securing of this kind is not required at certain times, a padlock can also advantageously be dispensed with. In order for the actuating lever to be held in the swiveled in position in this case, a hook device 58 is provided, e.g., at the swivel lever 128, which engages with a back-engagement surface 60 of the dish 118 when the actuating lever 128 is swiveled in, thereby holding the actuating lever 128 in the swiveled in position. The hook 58 which in this case is held so as to be swivelable about an axis 62 formed by the actuating lever 128 has a first actuating surface 64 which projects over the end of the actuating lever 128 and is directed in such a way that the user must grasp under this surface 64 of the lever 66 corresponding to an opening movement of the hand lever 128 in order to swivel the hook 58 out of its locked position (in the counterclockwise direction with reference to FIG. 5), wherein this pulling direction not only swivels the hook 58 out of its locking position, but also subsequently pulls the actuating lever 128 out of its swiveled in position after the hook is undone. This operating sequence is intuitive for the user and therefore represents a particularly advantageous embodiment form of this hook device 58.

The hook 58 can also be swiveled out of its locking position by a pressing movement in the direction of the hand lever surface 52 by means of a second actuating surface 70 which is provided in this instance and which projects beyond surface 52. Further, the additional lever arm forming this actuating surface 70 has, on its back, a recess 72 in which one end of the above-mentioned pressure spring 68 is received, while the other end of the pressure spring 68 is held on a protuberance 74 which is formed by the actuating lever 128.

The actuating lever 128 can be provided with an additional spring device in the area of its axis 30 in order to move the actuating lever 128 out of its swiveled in position automatically when required. In this case, when the actuating surface 70 of the hook 58 is pressed, this hook is released and the spring action presses the actuating lever out of its swiveled in position insofar as it is not impeded by an inserted padlock 48.

Figure 8:
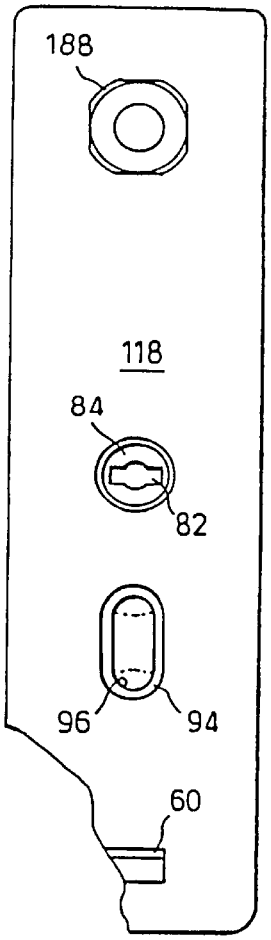
FIG. 8 shows a rear view of the dish of the arrangement according to FIG. 6.

As is shown in FIGS. 6, 7 and 8, a further locking possibility can be provided. This relates to a head pin 76 which is arranged approximately in the center of the actuating lever 128 and which may be mounted so as to be rotatable in a countersunk opening 78 of the actuating lever 128. The free end of the pin 76 has a cross-pin 80 which can be received in a determined position of the head pin 76 when the actuating lever 128 is swiveled into an opening 82 of the dish 118. The area of the dish 118 forming this opening 82 juts out somewhat so that back-engagement surfaces 84 are formed, wherein the ends of the pin 80 are located behind these back-engagement surfaces 84 when the head pin 76 is rotated by 90°. Accordingly, this is a kind of quarter-turn closure which makes it possible to lock the actuating lever 128 in its swiveled in position by means of this head pin 76. The rotation of the head pin 76 into and out of the locking position is carried out by means of a tool, in this case, a screwdriver, not shown, which is inserted into a slot 86 of the head pin 76. However, this purpose can also be met by a bar or a swivelable tongue when it can be moved against spring force by a cam or a connection which is rigid with respect to rotation, possibly with freewheeling.

According to FIGS. 1 and 3, the dish has a protrusion 88 which extends through the door leaf 16 where it is part of a lock shaft support and, e.g., according to FIG. 1, communicates with a lock case, wherein the door leaf 16 is clamped between the lock case and the dish 18 so that the dish is held firmly. The opening provided in the door leaf for this purpose is rectangular in this case, similar to that required in the construction according to the above-cited European Patent 0 054 225. According to FIG. 3, a construction is provided in which a disk 13 is provided instead of a lock case, wherein the sash tongue 22 on the one hand and projections for the articulation of the round rods 26 on the other hand proceed from this disk 13.

According to FIGS. 7 and 8, the dish 118 has a projection 188 which has a circular outer cross section and an external thread, possibly with flattened portions 187, so that the projection 188 can be used in conventional openings in the sheet-metal cabinet doors provided with necked down portions. A fastening screw (cap nut or union nut) can then be placed on the projection 188 and the door leaf can be clamped between this nut and the dish support surface 118. FIG. 11 shows an example for a fastening of this kind by means of a union nut 90.

The projection 40 carrying the eyelet 42 can be formed integral with the dish 118. However, for purposes of strength (e.g., when the dish is made of plastic), it is generally preferable that this projection 40 is provided as a separate structural component part, for example, as a metal projection which proceeds from a base plate 92. This base plate-can be inserted into a corresponding recess 94 of the dish 118 from the rear in such a way that its surface area is aligned with the surface area of the dish 118 (see FIGS. 7 and 8). The plate edges are then held by the projecting edges 96 of the dish 118. Alternatively, the projection 40 could also be injected into the material of the dish 118.

It is noted that when the actuating surface 70 is present, the projection 66 forming actuating surface 64 can also be omitted. This makes the actuating lever 128 somewhat shorter as a whole.

The padlock 48 shown in FIG. 7 projects out diagonally. The lock is accordingly somewhat easier to access but, on the other hand, has the disadvantage that it forms an impediment by projecting outward.

If this jutting out is troublesome, an embodiment form shown in different views, e.g., in FIGS. 9, 10, 11 and 12, is advantageous. The main difference between this embodiment form and those shown in FIGS. 5 to 8 consists in that the projection 140 is relocated to the lower end of the dish 218 so that the padlock 48 has room to hang down freely. The lower end 65 of the actuating lever 228, with reference to the Figures, is bent away somewhat from the door leaf 14 and the dish and accordingly makes it easier to pull the actuating lever 228 out of its swiveled in position after the padlock 48 is removed from the eyelet 142.

The eyelet 142 is designed in this case in such a way that it is formed by a projection 140 with a base 192 whose shape can be similar to that of the protrusion 188 in which the lock shaft 32 is supported, that is, with an external thread and, if required, two or four flattened portions, wherein a fastening nut 190 can be screwed onto the external thread so that the door leaf 14 is clamped between the fastening nut 190 and the dish 218. The dish 218 is held in turn by a ring 193 which is formed by the base 192 and is received in a corresponding recess 194 in the interior of the dish.

Figure 9:
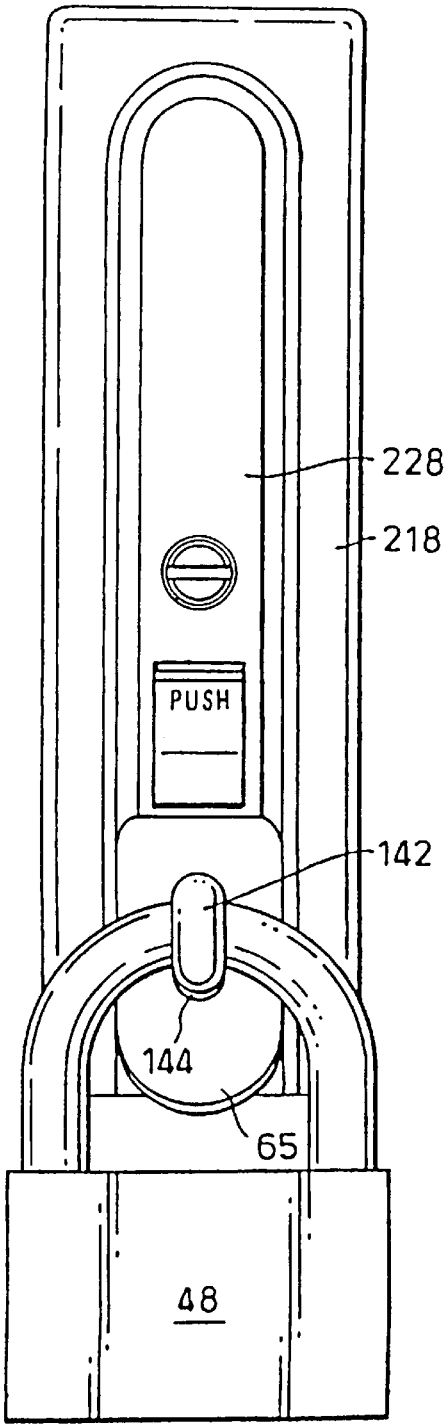
FIG. 9 shows a top view of another embodiment form of a swivel lever actuator construct according to the invention.
Figure 10:
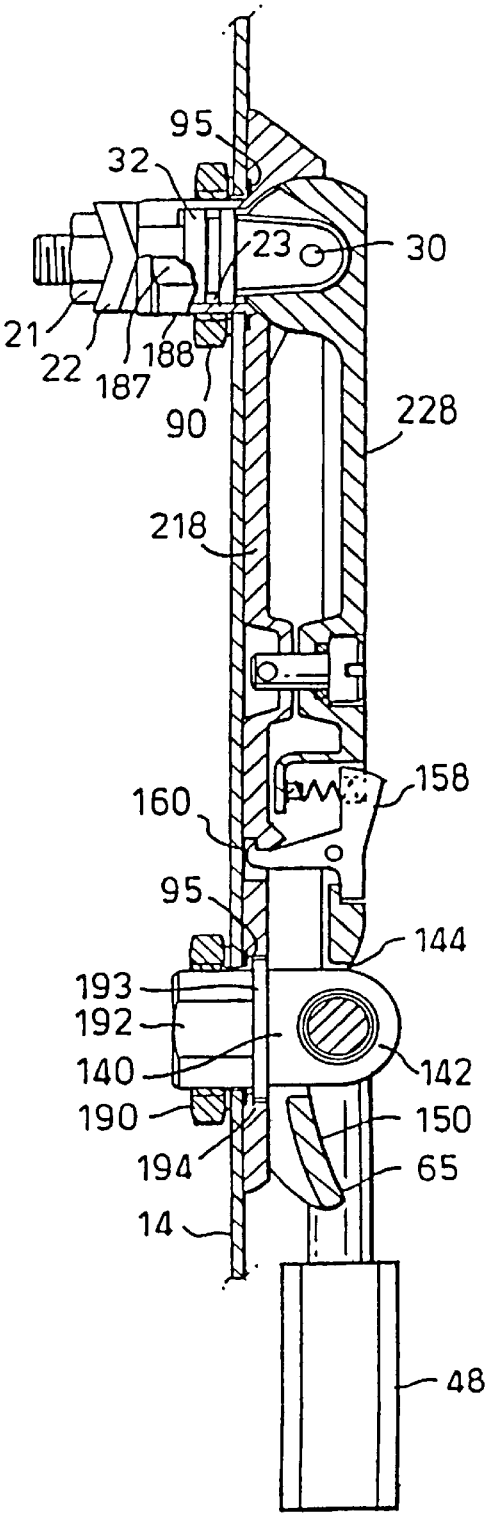
FIG. 10 shows a side view of the embodiment form according to FIG. 9 in section along the longitudinal axis.

The advantage of the construction shown in FIG. 9 and 10 is, for one, the greater stability provided by fastening by means of two protrusions 188, 192 which project over the support face of the dish and which are provided with a union nut 90 and 190, respectively, and, on the other hand, the fact that the padlock 48 does not project out as much.

Another advantage consists in that the closure can be used as a left-hand closure or right-hand closure in case the openings for the protrusions are arranged symmetric to the center of the door.

It is noted that the inner area of the switch cabinet can be sealed relative to its outer area by means of sealing rings 95 between the outer surface of the door leaf and the dish in the area of the protrusions 188 and 192 insofar as the shaft 32 at which the hand lever actuator 228 is articulated at 30 and to which the sash 22 may be fastened by screws 21 is outfitted with an O-ring seal 23.

Figure 12:
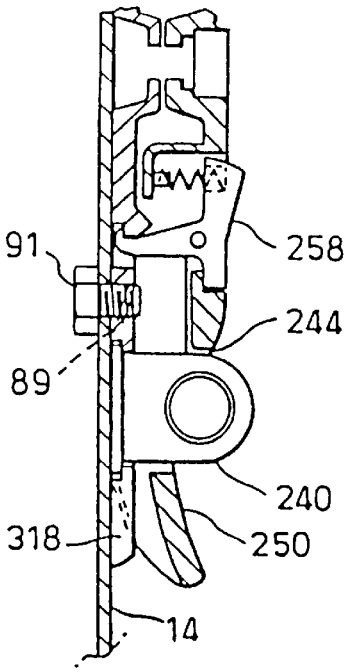
FIG. 12 is a view in partial section showing an embodiment form which is modified somewhat with respect to FIG. 10.

FIG. 12 shows a somewhat modified embodiment form in which the projection 240 is supported by the dish 318 in a similar manner to the projection 40 according to FIG. 7 instead of by fastening with a union nut 90. The dish 318 itself is held at the upper end by a nut 90 similar to FIG. 11, but is held at its lower end by a screw bolt 91 which is arranged with its bolt head on the back of the door leaf 14 and whose threaded part extends into a corresponding threaded bore hole 89 inside the material of the dish 318.

Figure 13:
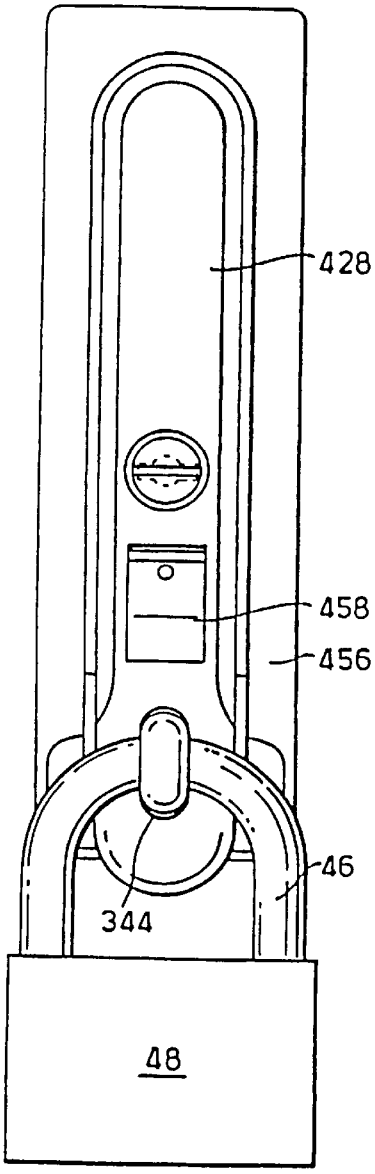
FIG. 13 shows a top view of a swivel lever actuator according to the invention having a different construction.
Figure 14:
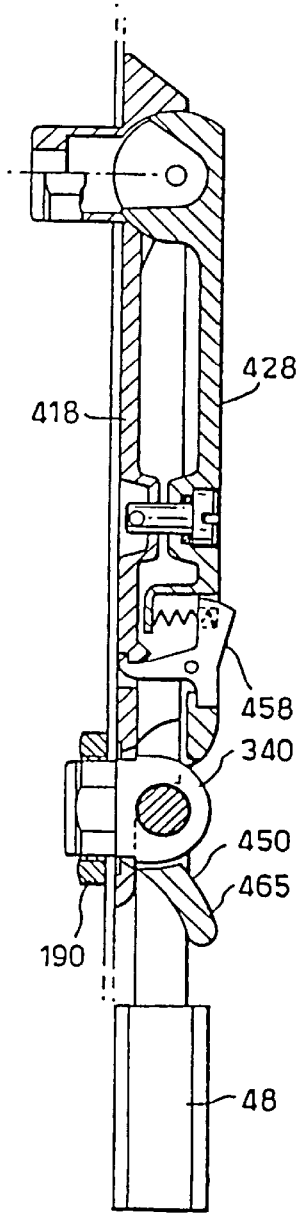
FIG. 14 shows a side view of the embodiment form according to FIG. 13 in section in the longitudinal direction.
Figure 15:
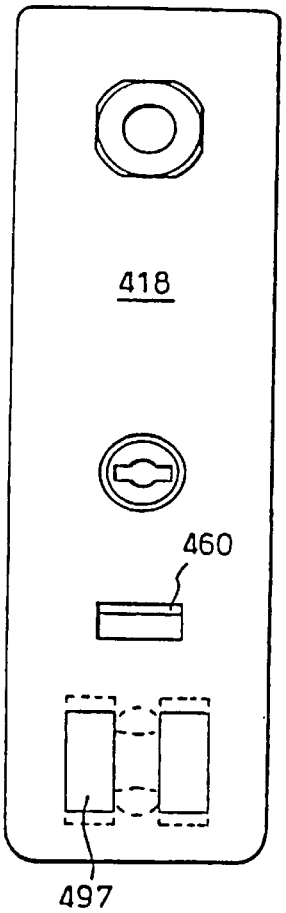
FIG. 15 shows a view from the rear of the dish according to FIG. 13.

While the eyelet of the protrusion 140 projects beyond the surface of the actuating lever 228 by a distance a in the embodiment forms in FIGS. 9 to 12, this is no longer the case in the present embodiment form shown in FIGS. 13, 14 and 15. The protection 340 is shorter and accordingly makes it possible for the actuating lever 428 and the dish 418 to be recessed more deeply for the shackle of the padlock 48 than was the case in the preceding embodiment forms. Additional space is created in that the front area 465 of the actuating lever 428 extends into a recess 497 of the dish 418 and accordingly retains sufficient material strength. The upper area of the eyelet 340 accordingly no longer projects over the upper surface of the actuating lever 428.

The padlock 48 also remains below the alignment line of the front surface of the swiveled in actuating lever, so that an extremely flat embodiment form results.

As is shown in FIG. 11, this embodiment form can also be constructed that is, with two protrusions for openings in the door leaf which are constructed, if required, so as to be identical in size for fastening by means of two nuts 90 and 190. Due to the arrangement of two identically sized holes which are advisably arranged symmetric to the center of the door, the closure can be switched from right to left in a simple manner.

This extremely flat version is particularly well-suited to be arranged in flush paths because there are no projecting parts to impede persons passing by quickly.

Due to the low height of the projection compared with the prior art, this is also less troublesome for the user's hand when the actuating lever is folded up and turned. Moreover, since the projection is at a further distance from the point of articulation of the actuating lever than in the prior art, there is more space between the actuating lever and the projection, so that the projection is also less troublesome for this reason.

The swivel lever lock according to the invention can also be used in closures which are actuated already when the actuating lever is swiveled out of the dish, that is, which do not require subsequent turning of the swivel lever.

Figure 16:
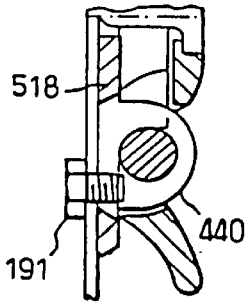
FIG. 16 shows an embodiment form which is modified somewhat relative to FIG. 14.

FIG. 16 shows a modification of FIG. 14 in which a head screw 191 holds the dish 518 at the lower end. The eyelet 440 is constructed integral with the dish 518.

The invention can be used commercially in switch cabinet construction.

While the foregoing description and drawings represent the present invention, it will be obvious to those skilled in the art that various changes may be made therein without departing from the true spirit and scope of the present invention.

What is claimed is:

1. A swivel lever actuator which can be secured by a padlock for the closure of a switch cabinet door comprising:

a dish having three side walls forming a trough which is adapted to be arranged on the outer surface of the door and in which is arranged a driving device for the closure;

an actuating lever being articulated at the driving device so as to be swivelable out of the dish about an axis extending parallel to the outer surface of the door;

a projection being mounted on the dish;

an eyelet being arranged at a free end of the projection so that when the actuating lever is swiveled into the dish, the projection extends through an opening in the actuating lever and so that a padlock inserted through the eyelet prevents the actuating lever from swiveling out;

said actuating lever forming an offset surface in the area of the opening; and a padlock which is inserted through the eyelet having a shackle which is received by the offset surface in a well fitting manner; and wherein of the three side walls forming a trough, two longitudinally orientated side walls of the dish have, in the area of the shackle, a recess corresponding to the offset surface in the area of the opening which receives the shackle in a well fitting manner, and wherein the actuating lever is encased on three sides by the dish having three side walls forming a trough when the actuating lever is swivelled into the dish.

2. The swivel lever actuator according to claim 1, wherein a hook is provided at the actuating lever and engages a back-engagement surface of the dish when the actuating lever is swiveled in and accordingly holds the actuating lever in the swiveled in position.

3. The swivel lever actuator according to claim 2, wherein the hook has an actuating surface and wherein the hook is released from the back-engagement surface when the actuating surface is pressed.

4. The swivel lever actuator according to claim 3, wherein the releasing movement of the hook is carried out against spring force.

5. The swivel lever actuator according to claim 1, wherein the actuating lever is swiveled in against a spring which exerts a spring force.

6. The swivel lever actuator according to claim 1, wherein the actuating lever also has a tool-actuated lock.

7. The swivel lever actuator according to claim 6, wherein the dish has two protrusions which are adapted to extend through a door leaf, wherein one protrusion forms a support for a lock shaft and the other protrusion is formed by a fastening for the projection for the eyelet.

8. The swivel lever actuator according to claim 7, wherein the protrusions form circumferential threads on which fastening screw nuts can be screwed and wherein the door leaf is adapted to be clamped between the fastening screw nuts and the dish.

9. The swivel lever actuator according to claim 1, wherein it is used for actuating at least one of a flat rod closure, a round rod closure and a sash closure.

10. The swivel lever actuator according to claim 1, wherein the driving device for the closure is a toothed-wheel drive.

11. The swivel lever actuator according to claim 1, wherein the driving device is a lever device.

12. The swivel lever actuator according to claim 1, wherein the driving device is a lock shaft.

13. A swivel lever rod lock for a switch cabinet door comprising:

a swivel lever actuator which can be secured by a padlock;

a dish having three sides forming a trough which is adapted to be arranged on the outer surface of the door and in which is arranged a driving device for a closure;

said swivel lever actuator being articulated at the driving device so as to be swivelable out of the dish about an axis extending parallel to the outer surface of the door;

a projection being mounted on the dish;

an eyelet being arranged at a free end of the projection so that when said swivel lever actuator is swiveled into the dish, the projection extends through an opening in said swivel lever actuator and a padlock adapted to be inserted through the eyelet prevents said swivel lever actuator from swiveling out;

said swivel lever actuator forming an offset surface in the area of the opening; and a padlock which is inserted through the eyelet having a shackle which is received by the offset surface in a well fitting manner, wherein two longitudinally orientated side walls of the dish have, in the area of the shackle, a recess corresponding to the offset surface in the area of the opening which receives the shackle in a well fitting manner wherein said lever actuator is encased on three sides by the dish having three side walls forming a trough when said lever actuator is swivelled into the dish.

14. The lock with said swivel lever actuator according to claim 13, wherein a hook is provided at the lever actuator and engages a back-engagement surface of the dish when the lever actuation is swiveled in and accordingly holds the lever actuator in the swiveled in position.

15. The lock with said swivel lever actuator according to claim 14, wherein the hook has an actuating surface and wherein the hook is released from the back-engagement surface when the actuating surface is pressed.

16. The lock with said swivel lever actuator according to claim 15, wherein the releasing movement of the hook is carried out against spring force.

17. The lock with said swivel lever actuator according to claim 13, wherein the lever actuator is swiveled in against spring force.

18. The lock with said swivel lever actuator according to claim 13, wherein the lever actuator also has a tool-actuated lock.

19. The lock with swivel lever actuator according to claim 18 wherein the dish has two protrusions which are adapted to extend through a door leaf, wherein one protrusion forms a support for a lock shaft and the other protrusion is formed by a fastening for the projection for the eyelet.

20. The lock with swivel lever actuator according to claim 13, wherein the protrusions form circumferential threads on which fastening screw nuts can be screwed, wherein the door leaf is adapted to be clamped between the fastening screw nuts and the dish.

21. The lock with said swivel lever actuator according to claim 13, wherein it is a flat rod closure or a round rod closure with or without a sash closure, whose locking rods are guided at a door leaf by means of rod guides and which are displaced in the rod guides in such a way by means of the driving device coupled with the swivel lever actuator that they are adapted to move into or out of receptacles formed by a door frame with locking devices, which are supported or formed by them and accordingly lock or unlock the door in the closed position.

22. The lock with swivel lever actuator according to claim 13, wherein the driving device for the closure is a toothed-wheel drive.

23. The lock with swivel lever actuator according to claim 13, wherein the driving device for the closure is a lever drive.

24. The lock with swivel lever actuator according to claim 13, wherein the driving device for the closure is a lock shaft.

* * * * *